United States Patent [19]

Bourque

[11] Patent Number: 4,533,076

[45] Date of Patent: Aug. 6, 1985

[54] DISPENSING OF ATTACHMENTS

[75] Inventor: Donald L. Bourque, Millis, Mass.

[73] Assignee: Dennison Manufacturing Company, Framingham, Mass.

[21] Appl. No.: 325,074

[22] Filed: Nov. 25, 1981

[51] Int. Cl.[3] ..... B25C 1/00

[52] U.S. Cl. ..... 227/67; 227/71; 227/101; 227/103

[58] Field of Search ..... 227/19, 67, 69, 120, 227/100, 101, 103, 71

[56] References Cited

U.S. PATENT DOCUMENTS

| | | | |
|---|---|---|---|
| 4,039,078 | 8/1977 | Bone | 206/343 |
| 4,111,347 | 9/1978 | Bone | 227/68 |
| 4,179,063 | 12/1979 | Russell | 227/67 |
| 4,180,196 | 12/1979 | Hueil et al. | 227/19 X |

*Primary Examiner*—Paul A. Bell

*Attorney, Agent, or Firm*—George E. Kersey

[57] ABSTRACT

Method and apparatus for the dispensing of attachments. The attachments are fed from a continuous roll of stock into position where an individual attachment is separated from the stock. Thereafter the stock and the separated attachment are advanced so that the attachment enters a movable slide and the stock occupies the prior position of the severed attachment. The slide is then moved with respect to one or more output needles so that a plunger may force the attachment from the slide through the needle or needles and dispense it into the material with which the attachment is being used. When the dispenser has dual needles, the attachments severed from the stock can be used as plastic staples for securing objects and items.

15 Claims, 16 Drawing Figures

FIG. 1A
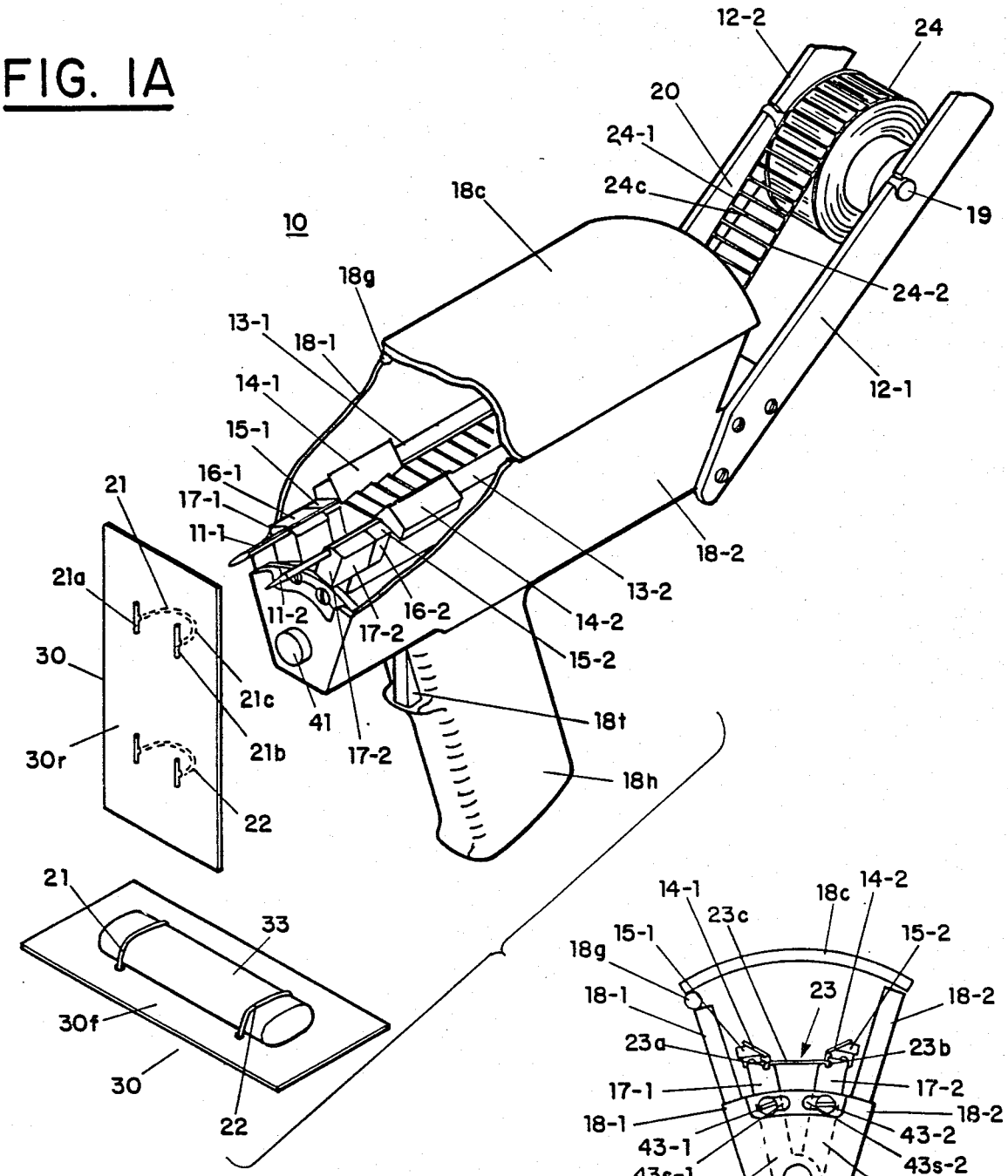
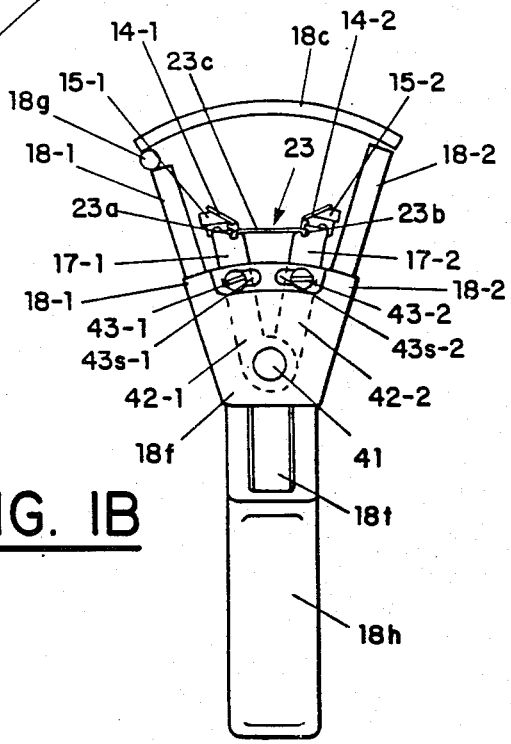
FIG. 1B

DISPENSING OF ATTACHMENTS

BACKGROUND OF THE INVENTION

The invention relates to the dispensing of attachments and more particularly to the dispensing of attachments from continuous stock, with the individual attachments of the stock used as plastic staples.

One type of device for the dispensing of attachments is disclosed in U.S. Pat. Nos. 4,039,078 of Aug. 2, 1977; 4,121,487 of Oct. 24, 1978; 4,111,347 of Sept. 5, 1978 and 4,179,063 of Dec. 18, 1979. In these patents the attachments are included in continuously connected stock formed by two elongated and continuous plastic side members coupled by a plurality of plastic cross links, which preferably are equidistantly spaced apart.

The stock may be produced from flexible plastics material such as nylon and polypropylene by molding or by stamping. Illustrative techniques for producing the stock are disclosed in U.S. Pat. Nos. 4,039,078, 4,121,487, 4,111,347 and 4,179,063.

Such attachments can be dispensed to couple buttons to fabric, merchandising tags to articles of commerce, and in the general attachment of one item to another. In particular in the case of dispensing devices with dual needles the attachments can be dispensed and used as plastic staples.

It is an object of the invention to facilitate the dispensing of attachments. A related object is to facilitate the dispensing of attachments that are used as plastic staples.

Another object of the invention is to facilitate the severing of individual attachments from continuously connected stock. A related object is to facilitate the formation of individual attachments from continuous stock to serve as plastic staples.

Still another object of the invention is to increase the reliability and utility of devices used in the dispensing of attachments, particularly attachments that are intended to serve as plastic staples.

SUMMARY OF THE INVENTION

In accomplishing the foregoing and related objects the invention provides for the feed of continuously connected stock, desirably of plastics material, to a position where an individual fastener is formed from the stock. This typically is achieved by severing an individual fastener from the stock, but it may also be achieved by isolating a pre-severed fastener from the remainder of the stock.

In accordance with one aspect of the invention, once an individual fastener is prepared it is fed into a slide that serves to position the individual fastener with respect to one or more output feed channels. The fastener and stock are desirably brought into position by a feed ratchet which is spring loaded to permit the ratchet to retract over the cross coupling elements of the fastener stock. The ratchet includes a plurality of feed notches which engage the rungs of the stock to achieve the desired positioning of the stock. When the individual attachments are severed from the remainder of the stock, this is desirably achieved by lever controlled knives. The slide is also lever controlled.

In accordance with another aspect of the invention the preparation and dispensing of the fasteners includes the steps of feeding the fasteners to a preparation station, forming an individual fastener, desirably by severing, advancing the stock and the prepared fastener so that the prepared fastener enters a positioning slide and the stock is thereafter advanced to occupy the position previously occupied by an individual fastener.

In the positioning step an individual fastener in the slide and the stock are simultaneously manipulated to provide the next fastener for feed. In the next step the slide is positioned so that the fastener which it contains can be expelled through at least one hollow needle.

Where the stock is in the form of a plastic staple one end is expelled through a first needle and the other end is simultaneously expelled through a second needle. The plunger is thereafter retracted until it clears the slide which is then positioned to receive the next individual fastener. The slide illustratively is an elevator which is raised to receive an attachment and then lowered to position the attachment for being dispensed through one or more hollow needles.

In accordance with a further aspect of the invention the stock is advanced in the direction of expulsion of the individual fasteners as the expulsion plunger is being retracted. In particular the fasteners are expelled over a first path and advanced over a second path that is displaced from the first path. The advancing mechanism desirably is a spring-loaded feed finger having a plurality of reciprocating triangular feed teeth.

In accordance with another aspect of the invention a connected plurality of said fasteners is advanced and an individual fastener is separated from the plurality and a slide that is movable between first and second positions receives a previously separated fastener at the first position. The separated fastener is then moved by the slide to a second position for being dispensed. The individual fastener is separated from the connected plurality by a blade which is pivotally mounted to move transversely with respect to the plurality. The blade desirably is controlled by the same mechanism as the movable slide.

In accordance with still another aspect of the invention the operations of the machine are controlled by a linear cam, which contains a plurality of distinctive, connective regions. In particular, the cam includes a first region for providing lost motion movement of the plunger and a second region disposed at an angle with respect to the first region for controlling the feed of the connected fasteners. An additional region is provided in the cam for controlling the sever of the connected fasteners. The further region is desirably interposed between the lost motion region and the feed region. In addition, the sever region is at an angle with respect to the first or lost motion region, while the sever region is at a greater angle to the lost motion region than for the feed region.

In accordance with still another aspect of the invention the expulsion takes place through at least one slotted hollow needle. The slotted hollow needle advantageously comprises two concentric cylinders, of which the lesser diameter cylinder is formed into a hypodermic point at the outward extremity of the needle. A flat can be provided on the upper cylinder at the entry portion into the device to permit interchangeability for the plural needle operation of the device.

DESCRIPTION OF THE DRAWINGS

Other aspects of the invention will become apparent after considering several illustrative embodiments taken in conjunction with the drawings in which FIG. 1A is a perspective view of a device for dispensing attachments to produce stapled objects in accordance with the invention;

FIG. 1B is a cross-sectional view of the front of the device of FIG. 1A;

DETAILED DESCRIPTION

Figure 2A:
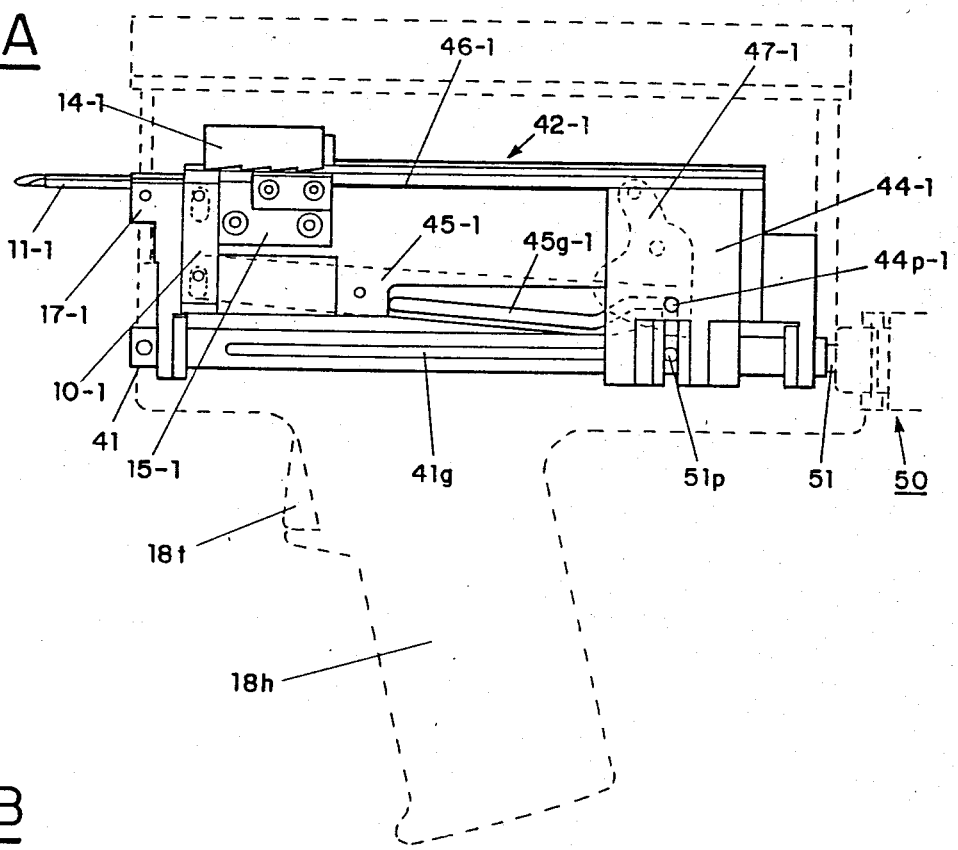
FIG. 2A is a partial longitudinal sectional view of the device of FIG. 1A showing the details of one of its feed, sever, and expulsion mechanisms.

With reference to the drawings, a dispensing device 10 in accordance with the invention is used to form individual fasteners which are fed from the device through dual output needles 11-1 and 11-2. One such attachment 21 is shown in FIG. 1A on a support board 30 after being expelled through dual needles 11-1 and 11-2 which have penetrated the board.

During the expulsion process the cross bars 21*a* and 21*b* of the attachment 21 are pushed through respective bores of the needles 11-1 and 11-2. During the expulsion the connector 21*c* that extends from the cross bar 21*b* to the cross bar 21*a* forms on arc from the slot of needle 11-1 to the slot of the needle 11-2. After the cross bars 21*a* and 21*b* are expelled and the needles 11-1 and 11-2 are withdrawn, the cross bars 21*a* and 21*b* reorient themselves on the reverse side of the board 30 according to FIG. 1A.

A second illustrative fastener 22 expelled from the device 10 appears on the support board 30 below the first expelled fastener 21.

In practice expelled fasteners such as 21 and 22 act as plastic staples in securing an item, such as the illustrative package 33, to the frontal side 30*f* of the support board 30. The individual plastic staples, such as 21 and 22, are formed in the device 10 from a roll 24 of stock 20.

In order to illustrate the positioning of the stock 20 within the device 10, its frontal portion is broken away to show feed fingers 14-1 and 14-2 that advance the stock 20 into respective underlying knife blocks 15-1 and 15-2 in which individual fasteners are severed from the remainder of the stock, after which elevators 16-1 and 16-2 are lowered into alignment with respective module assemblies 17-1 and 17-2.

When an individual plastic staple is in the module assemblies, it is in position for being dispensed through the needles 11-1 and 11-2 by respective plungers (not visible in FIG. 1A) that are mounted below feed blocks 13-1 and 13-2 for the feed fingers 14-1 and 14-2.

When the elevators 16-1 and 16-2 are in their upper positions for receiving a severed fastener from the stock 20, there is no path for entry of the plungers into the module assemblies 17-1 and 17-2. It is only when the elevators are lowered, carrying a severed fastener, the plungers are able to operate through the module assemblies 17-1 and 17-2 and expel the fasteners as desired.

The roll 24 of the stock 20 is positioned by a spindle 19 on support arms 12-1 and 12-2 mounted at the rear of the device 10 and extending upwardly at a suitable angle, for example 45°. The stock is formed by longitudinally extending side rails 24-1 and 24-2 with cross coupling elements or links 24*c*. The stock enters through the rear of the device 10 into the feed blocks 13-1 and 13-2 into contact with the feed fingers 14-1 and 14-2.

The device 10 also includes a housing 18 with side walls 18-1 and 18-2, a cover 18*c*, a handle 18*h* and a trigger 18*t*. The cover 18*c* is connected to the side wall 18-1 by a hinge 18*g* to facilitate the threading of the stock 20 into contact with the feed fingers 14-1 and 14-2.

A front view of the device 10 with the needles 11-1 and 11-2 removed from the module assemblies 17-1 and 17-2 is shown in FIG. 1B. In addition the module assemblies include a fastener 23 with cross bars 23*a* and 23*b* positioned in respective guide channels. The connector 23*c* for the fastener 23 spans from one module assembly 17-1 to another 17-2. Behind the module assemblies are knife blocks 15-1 and 15-2 with overlying feed fingers. The elevators 16-1 and 16-2 are not visible in FIG. 1B since they are in a lowered position behind the module assemblies 17-1 and 17-2.

The structural members that mount the various feed blocks, knife blocks, and feed fingers, are respective modules 42-1 and 42-2 which are pivotally mounted about a common shaft 41. The modules 42-1 and 42-2 are positioned relative to one another using adjusting screws 43*s*-1 and 43*s*-2 which are movable in slots 44*s*-1 and 44*s*-2 of a frontal plate 18*f*. This adjustment allows the span between the module assemblies 17-1 and 17-2 to be adjusted as desired and accommodate, for example different widths of stock 20. Also seen in FIGS. 1A and 1B is the front of a trigger 18*t* mounted in a handle 18*h*. As explained below, operation of the trigger 18*t* activates an air cylinder with a rod that moves along the interior of the pivot shaft 41.

The interior mechanism of the device 10 is illustrated in FIGS. 2A through 2D.

The device 10 of FIG. 2A is illustratively powered pneumatically from a cylinder 50 from which extends a rod 51. The latter includes a rod pin 51*p* which engages a plunger slide 44-1 which further includes an actuator pin 44*p*-1 for an elevator control lever 45-1. As the plunger block 44-1 is reciprocated back and forth by the movement of the cylinder rod 51 and its associated pin 51*p*, a plunger 46-1 is entered into and subsequently withdrawn from the knife block 15-1. Simultaneously the movement of the plunger slide 44-1 causes the pin 44*p*-1 to move in the control groove 45*g*-1 of the control lever 45-1 and also operates a rotatable feed cam 47-1 which controls the feed mechanism forward. The center portion of the control lever 45-1 operates the elevator 16-1, as well as a cutoff blade decribed below that is used in severing individual fasteners from the stock at a sever position.

It will be appreciated that the module 42-1 of FIG. 2A represents merely the left side of the feed and sever mechanism shown in FIG. 1B. The right side constituted by a module 42-2 is the mirror image of the left side. Consequently the reverse side of the mechanism shown in FIG. 2A corresponds to that for the right-hand module 42-2 shown in FIG. 2B. Both modules 42-1 and 42-2 are mounted on the common pivot shaft 41. Both are operated by the rod pivot 51*p* which moves in a groove 41*g* as the rod 51 is first extended and then retracted by the action of the pneumatic cylinder 50. The latter is shown in phantom in FIG. 2A.

Figure 2B:
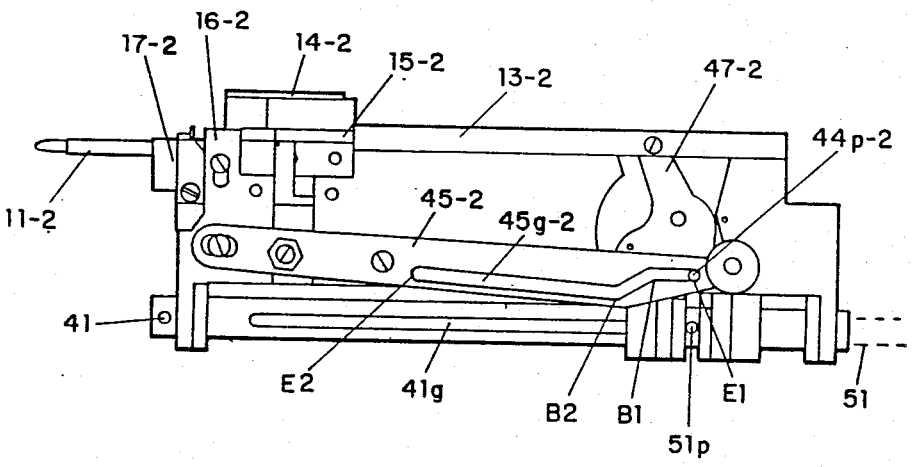
FIG. 2B is a longitudinal view of a companion mechanism to that of FIG. 1A showing the opposite side of the mechanism in detail.
Figure 2C:
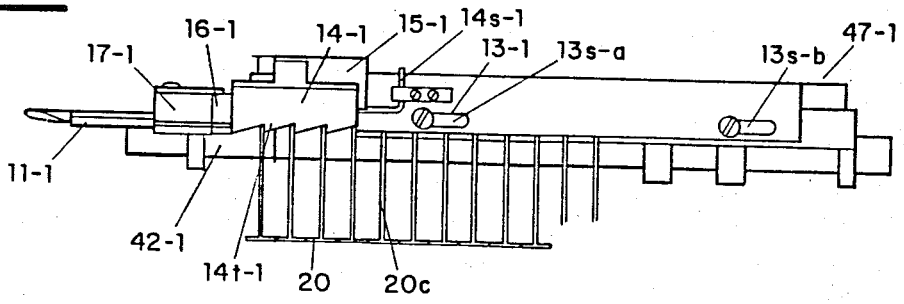
FIG. 2C is a partial top view of the feed mechanism for the device of FIGS. 1A and 1B.

The movement of the stock 20 below the feed block 13-1 is illustrated in FIG. 2C. As noted earlier the stock 20 is advanced from the roll 24 into the housing 18 (FIG. 1A). For that purpose the cover 18*c* has a hinge 18*g* in the side wall 18-1. When the cover 18*c* is elevated the operator views the machine 10 from the top as shown in FIG. 2C. The stock 20 is advanced into the machine beneath the feed fingers, of which only the feed finger 14-1 for the module 42-1 is visible in FIG. 2C. The feed finger 14-1 is connected at the front of the feed block 13-1. It is hinged to the feed block 13-1 and loaded by a spring 14*s*-1. The feed finger 14-1 has a series of four feed teeth which are triangular in form and proportioned to engage the connectors 20*c* of the stock 20. The user advances the stock 20 beneath the feed block 13-1 (and simultaneously between the opposite feed block 13-2 which is not visible in FIG. 2C) until the stock is in the position of the feed finger 14-1. Because the latter is spring loaded the stock 20 may be advanced further with a ratcheting effect, or the feed finger 14-1 may be elevated, by a pivot about its hinge against the tension of the spring 14*s*-1. The stock is desirably aligned below the triangular teeth 14*t*-1 of the feed fingers 14-1 as shown in FIG. 2C. Slight misalignment is compensated by the subsequent retraction and forward feed of the fingers 14-1 through the block 13-1. Movement of the feed block 13-1 is effected by the rotationally mounted feed cam 47-1 which is more clearly visible in FIG. 2A. The linkage between the feed cam 47-1 and the feed block 13-1 is similar to that shown for the companion feed cam 47-2 and block 13-2 in FIG. 2B. The feed block 13-1 is reciprocated with respect to slots 13*s*-*a* and 13*s*-*b* shown in FIG. 2C on the surface of the feed finger 14-1. As is explained in greater detail below the stock 20 is severed into an individual attachment in the knife block 15-1, the elevator 16-1 is raised into position for receiving the individual fastener severed from the stock, and the elevagtor 16-1 is subsequently lowered into position to permit feed of the severed fastener through the module assembly member 17-1 which serves as a mount for the needle 11-1.

Figure 2D:
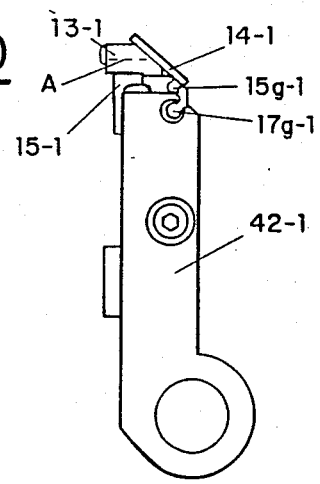
FIGS. 2D and 2E are respective front and rear views of the dispensing mechanism of FIG. 2A.
Figure 2E:
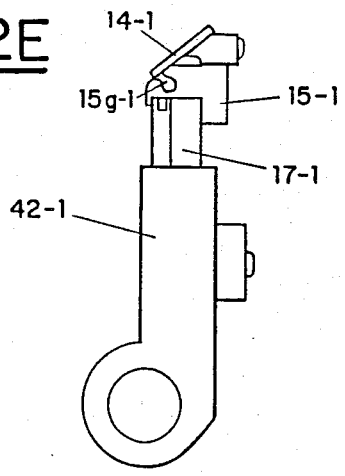

Front and rear views of the module 42-1 of FIG. 2B are set forth in FIGS. 2D and 2E respectively. In FIG. 2D the module assembly 17-1 is shown with the needle 11-1 of FIG. 2C removed exposing the guide channel 17*g*-1 through which the severed fastener is expelled by the plunger 46-1 of FIG. 2A. Also visible in FIG. 2D is the block 15-1 and the guide channel 15*g*-1 through which the stock 20 is advanced to position for severing of individual fasteners from the stock as described below. The elevator 16-1 of FIG. 2C is not visible in FIG. 2D since it is in its lowered position to permit a previously severed and entered fastener to be expelled through the guide channel 17*g*-1 of the module 17-1. Also indicated in FIG. 2D is the relationship between the feed finger 14-1 and the feed block 13-1. It is seen that the feed finger is mounted at an angle of elevation with respect to the lateral axis of the feed block of approximately 45°. The actual angular orientation of the feed finger 14-1 with respect to the lateral axis A of the feed block 13-1 can vary between about 10 and 60 degrees, depending upon the stock that is being fed and its characteristics.

Figure 3A:
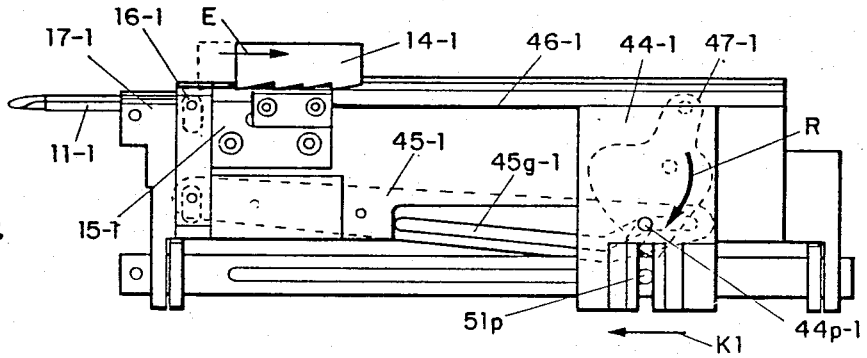
FIG. 3A is a further view of the feed mechanism of FIG. 2A in the completion of its initial stage of operation.
Figure 3B:
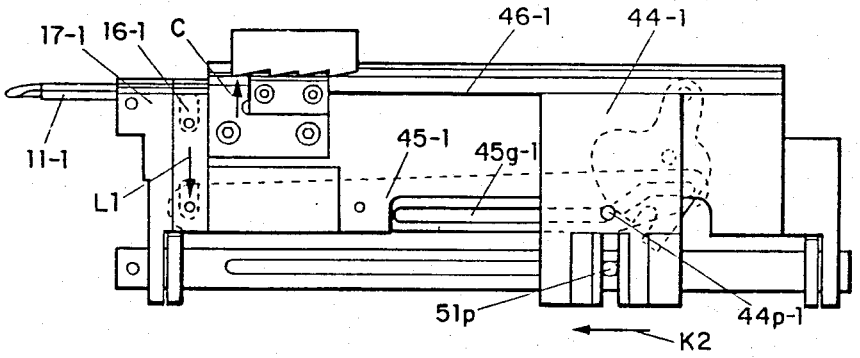
FIG. 3B is a view similar to that of 3A showing the machanism of FIG. 2A in the course of positioning a fastener for dispensing and severing of the stock to form an individual fastener.
Figure 3C:
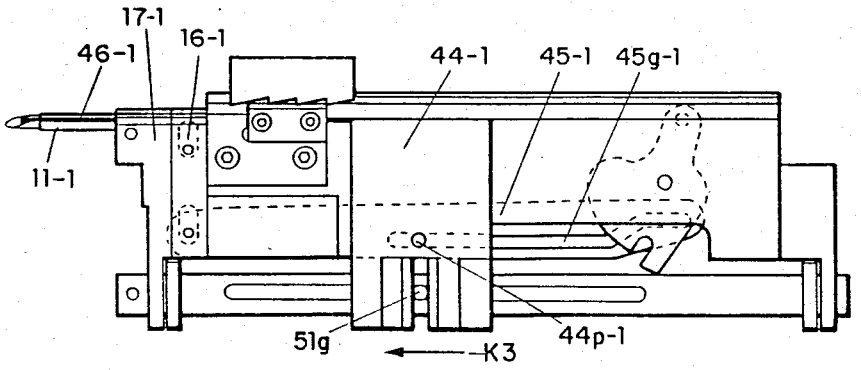
FIG. 3C is a view similar to that of 3B showing the mechanism in position for the expulsion of an attachment through associated dispensing needles.
Figure 4A:
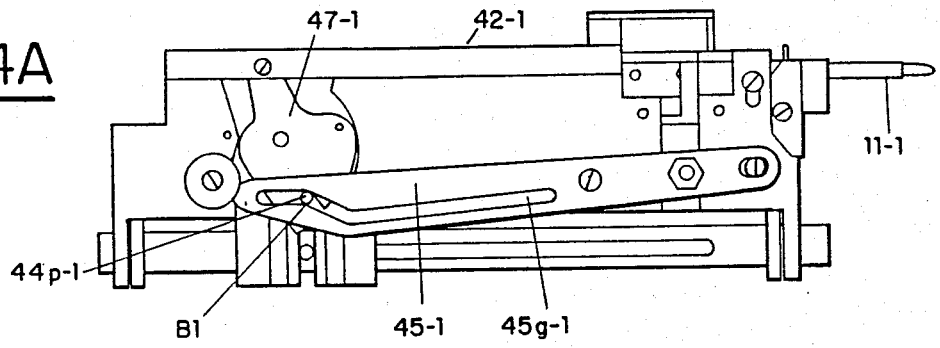
FIG. 4A is an opposite side view of the mechanism of FIG. 3A.
Figure 4B:
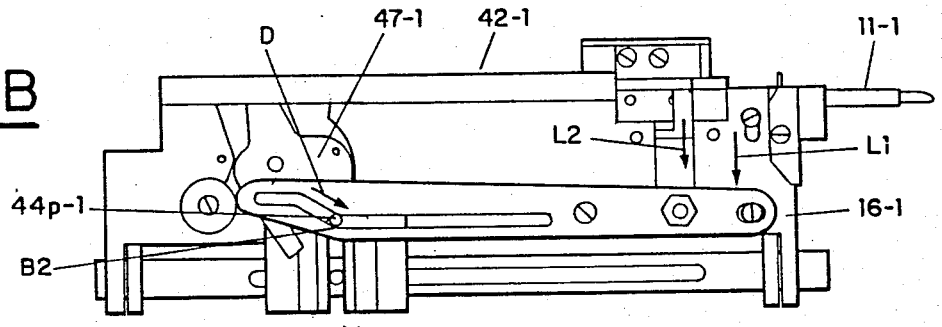
FIG. 4B is an opposite side view of the mechanism of FIG. 3B.

FIGS. 3A–3C illustrate one cycle of operation of the mechanism in the module 42-1. FIGS. 4A and 4B correspond to the opposite sides of respective FIGS. 3A and 3B on the companion module 42-2.

In FIG. 3A the mechanism is shown in the course of retraction of the feed finger 14-1 in order to prepare for subsequent advance of the stock 20 into the sever position and an individual plastic staple into the elevator 16-1. The plunger 46-1 has been advanced slightly from its position in FIG. 2A and the feed cam 47-1 exhibits maximum clockwise rotation R. The control lever 45-1 has had substantially no change compared with FIG. 2A. All that has happened is that the actuator pin 44*p*-1 has advanced along the control groove 45*g*-1 from the end of the groove to a first break point. This movement is brought about by the corresponding advance of the rod pin 51*p* which brings about a forward movement of the feed cam 47-1 as indicated by the arrow K1.

In FIG. 3B the cutter operation simulated by the arrow C has taken place in the knife block 15-1 (as described in detail below) and the severed fastener is held in the knife block until the next cycle. During the prior cycle the previously severed fastener was fed into the elevator 16-1 which is now lowered into alignment with the module assembly 17-1. The feed cam 47-1 is shown advanced further along its course as indicated by the arrow K2. This advance results in a decoupling of the actuator pin 44*p*-1 from the feed cam 47-1 and movement of the actuator pin along the control groove 45*g*-1 to a second break point position which results in lowering of the elevator 16-1 as indicated by the arrow L-1, into alignment with the module assembly 17-1 so that the previously severed fastener from the knife block 15-1 is in position for being expelled through the module 17-1, and hence through the needle 11-1 by further operation of the plunger 46-1.

Further operation of the mechanism is shown in FIG. 3C. The plunger slide 44-1 has moved forwardly to almost the end of its travel which is fixed by the closed end of the control groove 45*g*-1. In FIG. 3C the actuator pin 44*p*-1 is shown having moved from its second break point position to near the end of the groove. The region of travel for the pin 44*p*-1 from the second break point position to the end of the control groove is associated only with the advance of the plunger 46-1 into the elevator and then into the feed groove 17*g*-1 (FIG. 2D). This results in expulsion of the fastener out of the needle 11-1 as described previously.

The reverse side of the module 42-1 of FIG. 3A is shown in FIG. 4A. As can be seen the actuator pin 44*p*-1 is at the first break point B1 of the control groove 45*g*-1 in the control lever 45-1. Also clearly indicated in FIG. 4A is the engagement of the pin 44*p*-1 with the feed cam 47-1.

In FIG. 4B, which corresponds to the reverse side of the module in FIG. 3B, the pin 44*p*-1 has advanced to a second break point B2 in the control groove 45*g*-1 as indicated by the arrow D. It is this movement which operates the cutter in the block 15-2 by movement in the downward direction indicated by the arrow L-2. There is a simultaneous lowering of the elevator 16-1 as indicated by the arrow L-1.

Figure 5A:
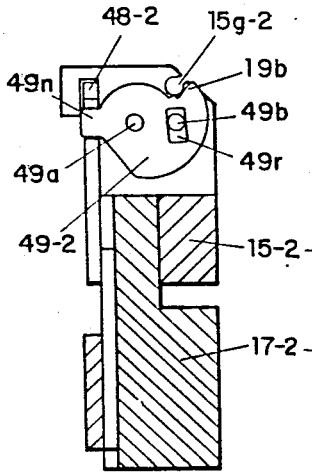
FIGS. 5A and 5B are sectional views showing the operation of cutter in accordance with the invention.
Figure 5B:
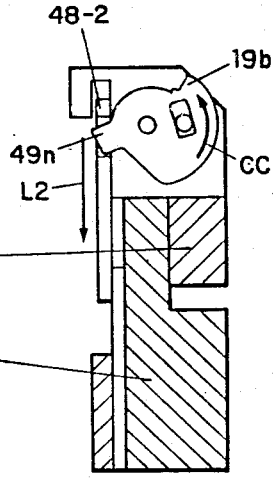

The cutter operation is illustrated in FIGS. 5A and 5B. When the control lever 45-2 is elevated as shown in FIG. 4A, a cutter link 48-2 is maximally elevated as shown in FIG. 5A. As the control lever 45-2 moves from its elevated position in FIG. 4A to its lowered position in FIG. 4B, occasioned by the movement of the control pin **44*p*-2 in the slot 45*g*-1 from its first break point B1 (FIG. 4A) to its second break point B2 (FIG. 4B) the effect is as shown in FIG. 5B with the downward movement of the control lever 48-2 engaging a projection 49*p* on a rotatable cutter 49-2 and causing it to rotate in a counterclockwise direction indicated by the arrow C which brings about severance of an individual fastener from the remainder of the stock. For example, the guide channel 15*g*-2 is shown unoccupied in FIG. 5A but it will be understood that in operation the guide channel 15*g*-2 is occupied by the side rail 24-1 of FIG. 1A. The total rotational movement of the cutter 49-2 is determined by the movement of the control lever by the pin 44*p*-2 in control groove 45*g*-2 from break point B1 to break point B2. As seen in FIG. 5B when the rotatable knife blade 49-2 has been operated its blade 49*b* completely traverses the groove 15*g*-2, and the latter remains closed until there is a subsequent elevation of the link 48-2 which brings about clockwise rotation of the blade about its axis 49*a***.

Figure 6A:
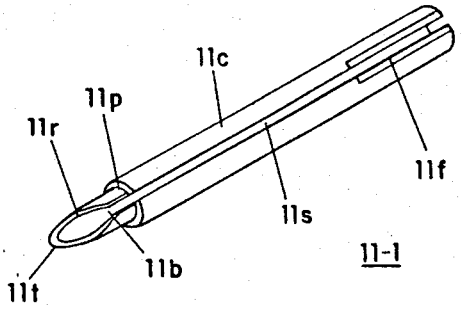
FIGS. 6A and 6B are perspective views of a needle for use in the device of FIG. 1A.
Figure 6B:
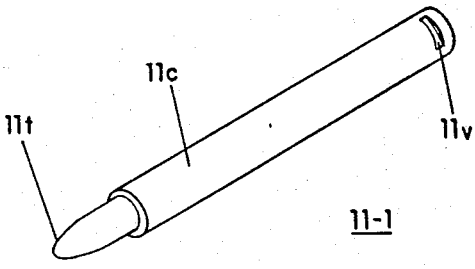

Details of the needles 11-1 and 11-2 are shown for the illustrative needle 11-1 of FIGS. 6A and 6B. Each of the needles includes a cylindrical shank **11*c* with a concentric shank of reduced diameter 11*r* that terminates in a tip 11*t* that is formed by passing a plane at an angle with respect to the cylinder 11*r*. The result is a tip of the kind found in hypodermic needles, which is particularly suitable for penetrating board stock of the kind 30 shown in FIG. 1B. This type of needle is significantly different than the needle commonly employed in the dispensing of fasteners. The needle includes a hollow bore 11*b* that extends from the tip 11*t* through the reduced cylinder 11*r* along the main cylinder 11*c*. It is the bore 11*b* that provides for the longitudinal movement of the cross bars, for example 21*a* or 21*b* of the illustrative fastener 21 shown in FIG. 1A. The filament 21*c* that is connected to the cross bars extends outwardly through the side slot 11*s* that extends along the entire length of the main mount 11*c* and the reduced diameter extension 11*r*. The interface between the mount 11*c* and the extension 11*r* is in the form of a step surface 11*p* that is desirably at a right angle with respect to the axis of the bore 11*b*. The step surface 11*p* is desirable in order to limit the extent of penetration of the needle into the mounting board 30 of FIG. 1A. The mounting portion of the needle 11-1 also includes a flat 11*f* which is provided for proper orientation of the needle in the module 17-1. The same needle 11-1 can be used with the associated module 17-2 so that the needles or the dispenser 10** are interchangeable.

An opposite side perspective view is shown in FIG. 6B. The needle 11-1 includes a verticle groove **11*v* on its shank 11*c* in order to permit the needle to be locked in to the associated module 17-1 or 17-2**.

The illustrated operation is in terms of a hydraulic cylinder 50 and its associated rod 51 (FIG. 2A). The trigger **18*t* of FIG. 2A controls the operation of a valve for the hydraulic cylinder 50 in conventional fashion. It will be appreciated that other forms of operation are equally possible and that the hydraulic cylinder 50 can be replaced by a solenoid and centerpiece which is caused to operate translationally by electrical activation and deactivation. In addition the rod 51 may be operated entirely mechanically by coupling the trigger 18*t* to a set of conventional gears and levers which produce a forward and return stroke for the rod 51 according to the extent of depression of the trigger 18*t* into the handle 18*h***.

The operation of the dispensing device may be summarized in the following way:

1. Initially the plunger slides 44-1 and 44-2, and their pins **44*p*-1 and 44*p*-2 are in their rearmost positions as shown in FIG. 2A for slide 44-1 and pin 44*p*-1**. In this position the plunger is maximally withdrawn, the elevator is maximally elevated, the cutter is deactivated and the feed fingers are maximally forward.

2. As the plunger slides 44-1 and 44-2 move towards the front of the device, the pins **44*p*-1 and 44*p*-2 in the three-segment control grooves 45*g*-1 and 45*g*-2 move to the first break point of the three segments. In this position, as illustrated by FIG. 3A, the feed cams 47-1 and 47-2 have their maximal clockwise rotations R and the feed fingers 14-1 and 14-2** are moved maximally towards the rear of the device.

3. As the plunger pins **44*p*-1 and 44*p*-2 move from the first break point to the second break point of the control groove, reaching the position shown in FIG. 3B, the cutter in the guide block is operated as indicated by the transition from the setting of FIG. 5A to the setting of FIG. 5B**, and the elevators are lowered into position for expulsion of the fastener through the needles.

4. As the plunger guide pins **44*p*-1 and 44*p*-2 move from the second break point B2 towards the end E2 of each of the slots 45*g*-1 and 45*g*-2 the plungers 46-1 and 46-2 are moved through the elevators 16-1 and 16-2 and force any severed fasteners contained there through the output needles 11-1 and 11-2**.

5. In the return stroke as the plunger pin moves from its most forward position in the control groove towards the second break point there is essentially only withdrawal of the plunger from the module assemblies and the elevator.

6. As the plunger pin moves upwardly from the second break point to the first break point it rotates the cutter blade and clears the feed channel in the feed block and simultaneously raises the elevator. It also engages an open slot in the feed cam so that in the subsequent travel of the plunger pin from the first break point to the end of the control groove the feed fingers are moved forwardly to advance the previously severed fastener into the elevator.

7. Thereafter the cycle repeats itself. It is to be seen that an important aspect of the invention is the provision of a control lever with a three-segment control groove. The first segment of the control groove which extends from the most rearward position of the groove to a first break point, i.e. a position where the groove which in its course is a straight line segment that is essentially parallel with the axis of the lever. This portion of the groove is only concerned with the advance and retraction of the plunger and feed fingers for further advance of the stock into the knife blocks to permit severing. The second portion of the control groove, which extends between the first and second break points providing a channel which is disposed at an acute angle of elevation relative to the axis of the lever, controls the raising and lowering of the elevator and the operation of the cutter in the knifeblock. There is also movement of the plunger while this is taking place. The final portion of the groove which extends from the second break point parallel to the angle of elevation relative to the axis of the lever is essentially responsible for the expulsion of the severed fastener through the needles.

While various aspects of the invention have been set forth by the drawings and specification, it is to be understood that the foregoing detailed description is for illustration only and that various changes, as well as the substitution of equivalent constituents shown and described may be made without departing from the spirit and scope of the invention as set forth in the appended claims.

I claim:

1. Apparatus for dispensing fasteners, each fastener having a pair of side members coupled by a link, comprising:

at least one slotted hollow needle;

first means for expelling individual ones of said fasteners through said needle, said means being reciprocable in an expulsion direction and a withdrawal direction;

second means for advancing a connected plurality of said fasteners;

third means for actuating said first and second means, said third means reciprocating said first and second means along an expulsion and a withdrawal direction, said third means moving said first means in the withdrawal direction at the same time as it moves said second means in the expulsion direction.

2. Apparatus for dispensing fasteners as defined in claim 1 wherein said fasteners are expelled over a first path and advanced over a second path displaced from said first path.

3. Apparatus as defined in claim 1 wherein each individual fastener is separated from said connected plurality by a blade which is pivotally mounted with respect to a knife block to move transversely with respect to said plurality.

4. Apparatus as defined in claim 3 wherein said blade is controlled by said third means.

5. Apparatus as defined in claim 1 wherein the advancing means comprises a spring loaded feed finger having a plurality of triangular feed teeth and means for reciprocating said feed finger.

6. Apparatus as defined in claim 5 wherein said third means are a linear cam.

7. Apparatus as defined in claim 6 wherein said linear cam contains a plurality of distinctive, connected regions.

8. Apparatus as defined in claim 7 wherein said cam includes a first region for providing lost motion movement of the plunger and a second region disposed at an angle with respect to the first region for controlling the feed of the connected fasteners.

9. Apparatus as defined in claim 8 wherein said cam further includes an additional region for controlling the severance of the connected fasteners.

10. Apparatus as defined in claim 9 wherein the further region of said cam is interposed between the lost motion region and the feed region.

11. Apparatus as defined in claim 10 wherein the severance region of said cam is at an angle with respect to the first or lost motion region.

12. Apparatus as described in claim 11 wherein the severance region of said cam is at a greater angle to the lost motion region than for the feed region.

13. Apparatus as defined in claim 1 wherein said slotted hollow needle comprises two concentric cylinders, of which the lesser diameter cylinder is formed into a hypodermic point at the outward extremity of said needle.

14. Apparatus as defined in claim 13 wherein one side of said slotted hollow needle includes a flat on the upper cylinder at the inward extremity of said needle to permit interchangability for the plural needle operation of said apparatus.

15. Apparatus as defined in claim 14 including a groove on the opposite side of said cylinder parallel to said flat for the releasable retention of said needle.

* * * * *